US006178581B1

(12) United States Patent
Lewis

(10) Patent No.: US 6,178,581 B1
(45) Date of Patent: Jan. 30, 2001

(54) MOP SCRUBBER ADAPTER

(75) Inventor: Larry I. Lewis, Rockford, IL (US)

(73) Assignee: National Metal Specialist Corporation, Rockford, IL (US)

( * ) Notice: Under 35 U.S.C. 154(b), the term of this patent shall be extended for 0 days.

(21) Appl. No.: 09/255,481

(22) Filed: Feb. 23, 1999

Related U.S. Application Data

(60) Provisional application No. 60/075,738, filed on Feb. 24, 1998.

(51) Int. Cl.[7] ..... A47L 13/146
(52) U.S. Cl. ..... 15/116.2; 15/119.2
(58) Field of Search ..... 15/114, 116.1, 15/116.2, 119.1, 119.2

(56) References Cited

U.S. PATENT DOCUMENTS

| | | |
|---|---|---|
| D. 358,487 | 5/1995 | Kneesch et al. . |
| 603,999 | 5/1898 | Ballam . |
| 2,472,781 | 6/1949 | Vosbikian et al. . |
| 2,534,086 | 12/1950 | Vosbikian et al. . |
| 2,641,787 | 6/1953 | Vosbikian et al. . |
| 2,643,407 | 6/1953 | Vosbikian et al. . |
| 2,701,888 | 2/1955 | Vosbikian et al. . |
| 2,730,741 | 1/1956 | Gantz . |
| 2,834,035 | 5/1958 | Vosbikian et al. . |
| 2,858,557 | 11/1958 | Zottola . |
| 2,895,152 | 7/1959 | Vosbikian et al. . |
| 2,916,754 | 12/1959 | Zottola . |
| 2,935,754 | 5/1960 | Abdo et al. . |
| 3,964,121 | 6/1976 | Kim . |
| 4,491,998 | 1/1985 | Wilson et al. . |
| 4,654,920 | 4/1987 | O'Neil, Jr. et al. . |
| 5,416,945 | 5/1995 | Price . |
| 5,483,720 | 1/1996 | Decoopman et al. . |
| 5,488,750 | 2/1996 | Vosbikian et al. . |

*Primary Examiner*—Randall E. Chin
(74) *Attorney, Agent, or Firm*—Leydig, Voit & Mayer Ltd.

(57) ABSTRACT

A scrubber adapter for attachment to a butterfly mop presents a brush surface for performing scrubbing operations on the surface to be cleaned. The brush provides a familiar tool to the typical mop user and therefore is more likely to be used in the appropriate manner. Furthermore, the brush is less abrasive than other scrubber strip type materials and therefore is less likely to damage the surface. In an alternative embodiment, the brush is attached to a base to form a brush head which may be removed from the remainder of the adapter. As a result, the brush may be quickly and easily replaced without replacing the entire scrubber adapter.

4 Claims, 4 Drawing Sheets

24
14
26
12
28
22
20
16
32
30
22
20
18
10

MOP SCRUBBER ADAPTER

CROSS-REFERENCE TO RELATED APPLICATION

This application claims the priority date benefit of U.S. Provisional Patent Application Serial No. 60/075,738, filed on Feb. 24, 1998, pursuant to 37 CFR §1.78(a)(3).

FIELD OF THE INVENTION

The present invention generally relates to mops, and more specifically relates to mops having scrubbers.

BACKGROUND OF THE INVENTION

Conventional mops typically have a sponge attached at one end for absorbing water and detergent and for performing routine cleaning operations. In general, liquid and dirt may be squeezed from the sponge in one of two manners. First, the mop may have rollers or a squeeze plate which compresses the sponge along its length. In the alternative, the mop may fold the sponge across its length so that two halves of the sponge compress against each other. The present invention relates to this second style, which is commonly referred to as a butterfly mop.

Unfortunately, previous butterfly mops do not satisfactorily remove more difficult stains such as scuffs or ground-in marks. The typical sponge on conventional butterfly mops is not abrasive enough to remove more difficult stains. Other mops, such as that described in U.S. Pat. No. 5,522,110 to Borofsky, have a mop head carrying a sponge but also incorporate brush bristles adjacent the sponge to clean difficult stains. The bristles of the brush and the sponge are disposed in the same direction so that the mop presents a single and relatively uniform cleaning surface. It will be appreciated, however, that it is difficult to use either the sponge or the brush alone. For example, the body of the sponge will interfere with the use of the brush by resisting downward force applied to the mop. In like manner, the relatively stiff brush bristles will come into contact with the surface to be cleaned once the sponge is compressed, thereby making it difficult or impossible to clean with the sponge alone. While scrubbing may be needed to remove difficult stains, it is not always preferable since scrubbing tends to scratch or mar the surface to be cleaned. When using previous devices, therefore, it is difficult to control whether the mop performs routine cleaning or scrubbing operations.

Other mops are known which support a scrubber strip with a scrubbing surface disposed normal to the cleaning surface of the sponge. As a result, the cleaning operation performed by the mop is more simply and easily controlled. For routine mopping operations, the mop is held so that the sponge is disposed toward the surface to be cleaned. In this position, the scrubber strip is supported normal to the sponge and therefore does not interfere with the mopping operation performed by the sponge. To clean more difficult stains, the mop handle may be rotated so that the scrubber strip is disposed toward the surface. In this position, the sponge is spaced from and disposed normal to the scrubber strip and therefore does not interfere with the scrubbing operation. A significant problem with these previous devices is the material used for the scrubber strip. The previous devices have heretofore used a plastic stranded material similar to glass wool. As a result, the stranded material easily scratches or mars the surface to be cleaned. Furthermore, the mop user is not likely to be familiar with the scrubber strip material and therefore does not use the scrubber strip properly, thereby increasing the chances of scratching the surface.

The replacement of scrubber surfaces on previous devices is also difficult and overly cumbersome. The brush bristles are typically attached to a holder which is secured in place on the mop head. In order to change the brush, the entire holder must also be removed and replaced. As a result, brush replacement is overly difficult and time consuming.

SUMMARY OF THE INVENTION

In view of the foregoing, it is a general aim of the present invention to provide a scrubber adapter for attachment to a butterfly mop which is more easy to recognize and control.

In that regard, it is an object of the present invention to provide a scrubber adapter which minimizes the risk of scratching or marring the surface to be cleaned.

It is also an object of the present invention to provide a scrubber adapter having a scrubbing surface which may be quickly and easily replaced.

In view of these objects, it is a feature of the present invention to provide a scrubber adapter for attachment to a butterfly mop in which a number of bristles are attached to the adapter to form a separate brush. The adapter has arms for attachment to the mop head so that a scrubbing surface of the brush is disposed substantially perpendicular to a cleaning surface of the sponge attached to the mop. A typical mop user may more readily identify with the brush and is more likely to know how to operate the brush, thereby minimizing scratching or marring of the surface to be cleaned. An additional feature of the present invention is to attach the bristles of the brush to a removable backing which is mechanically yet releasably secured to the scrubber adapter support. The removable backing facilitates replacement of the brush without requiring the entire adapter to be removed and replaced.

These and other objects, advantages, and features of the present invention will become more apparent from the following detailed description when taken in conjunction with the accompanying drawings.

Figure 1:
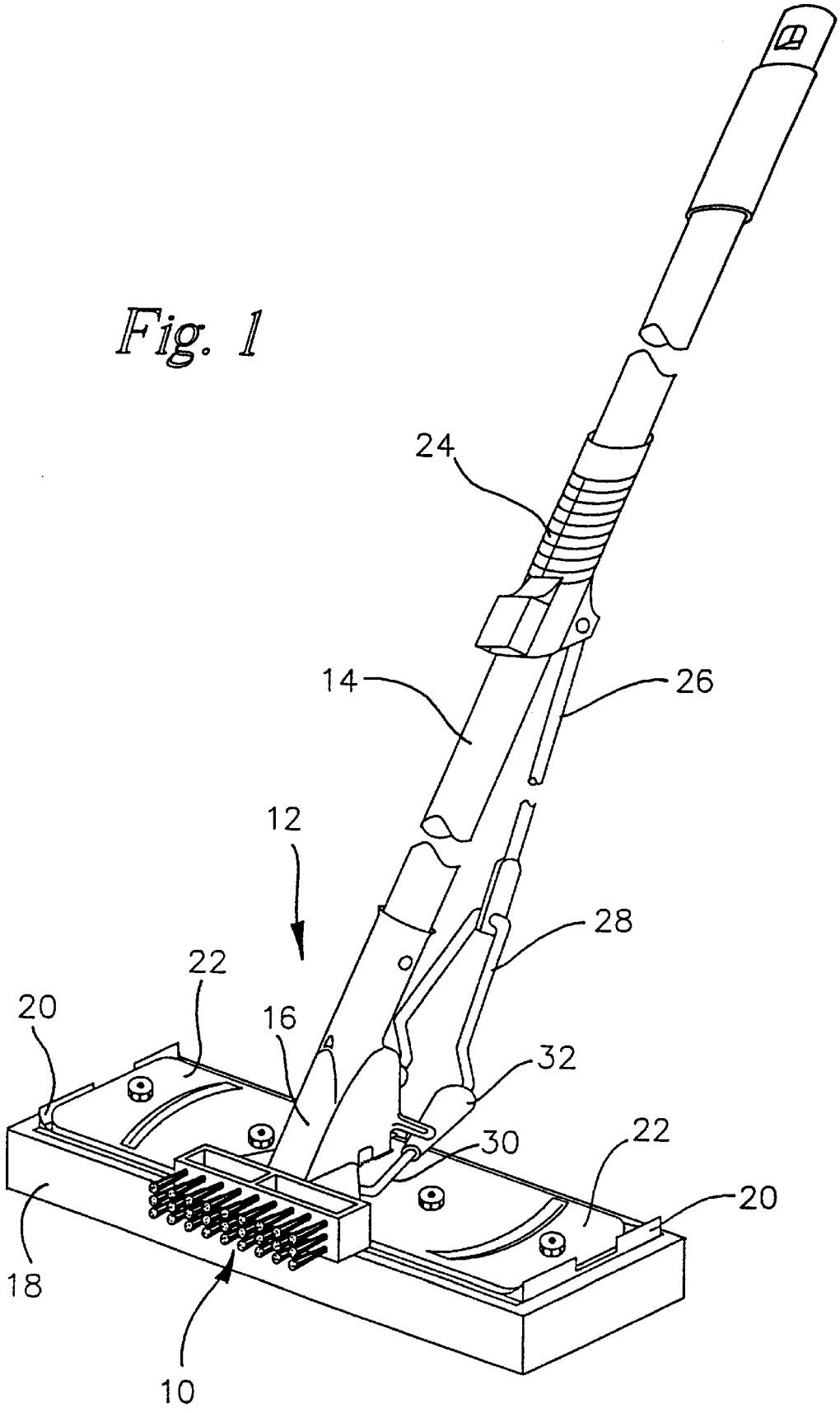
FIG. 1 is a perspective view showing a scrubber adapter attached to a butterfly mop with a sponge in the operative position.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is cover all modifications, alternative constructions, and equivalents falling within the spirit and scope of the invention as defined by the appended claims.

DETAILED DESCRIPTION OF THE PREFERRED EMBODIMENTS

Referring now to the drawings, and specifically to FIG. 1, a scrubber adapter 10 is shown attached to a butterfly mop 12. The butterfly mop 12 has a handle 14 connected to a head attachment 16 which supports a sponge 18. The sponge 18 has two backing plates 20 secured to squeeze plates 22. The squeeze plates 22 are supported for movement between operative and squeeze positions. In the operative position, best shown in FIG. 1, the squeeze plates 22 are substantially planar. In the squeeze position, the outer edges of the squeeze plates 22 are rotated toward each other so that the sponge 18 folds substantially in half. In the squeeze position, therefore, the sponge is compressed to release liquid.

Figure 2:
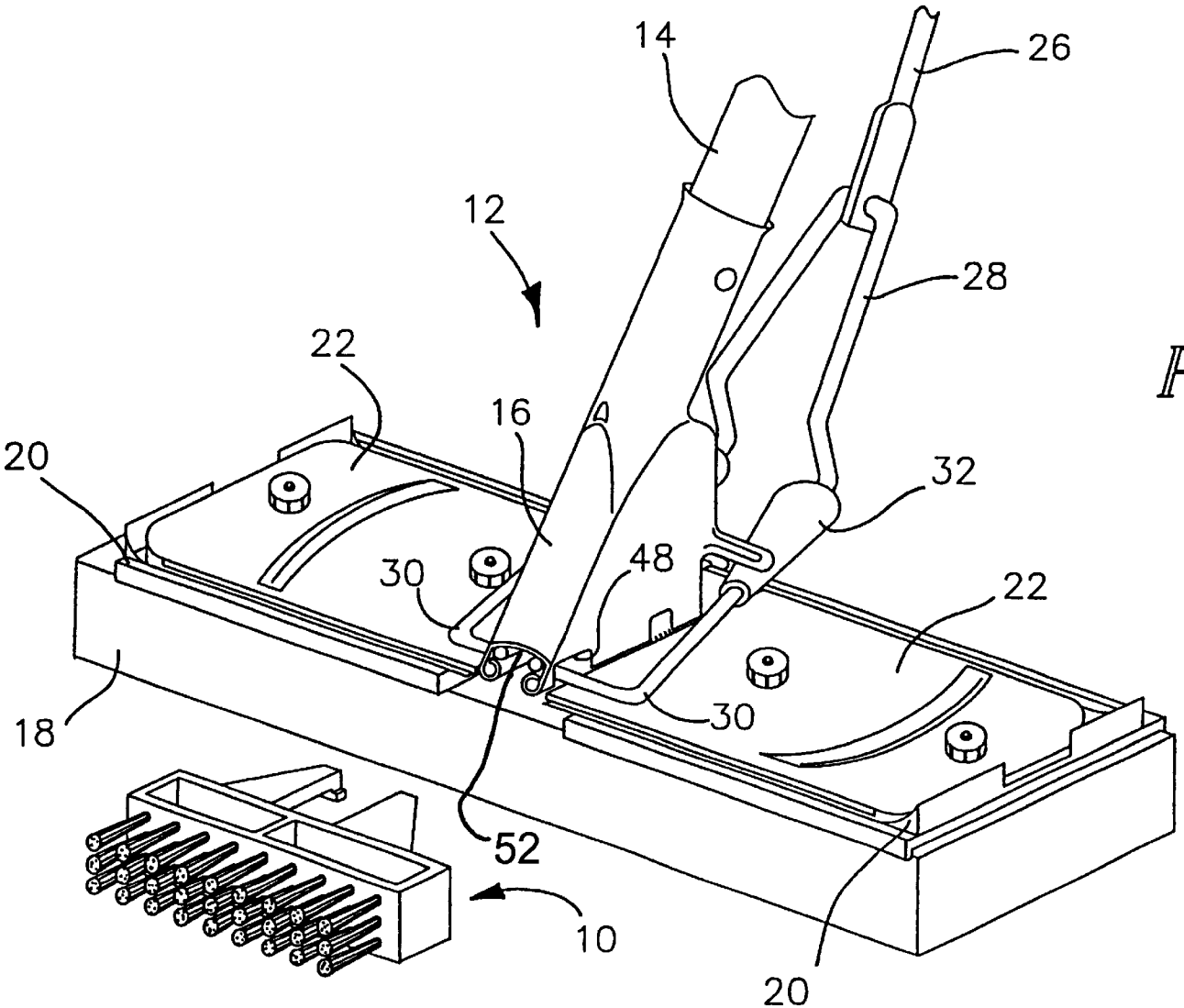
FIG. 2 is an enlarged perspective view of the scrubber adapter exploded from the butterfly mop.

A squeeze handle 24 is provided for actuating the squeeze plates 22. As illustrated in FIGS. 1 and 2, the squeeze handle 24 is located mid-way along the mop handle 14 and is supported for sliding movement along the mop handle 14. The squeeze handle 24 is connected to a driving link 26 which in turn is connected to a fork 28. The fork 28 has two arms 30, the ends of which are secured inside the head attachment 16. A tapered roller 32 is journaled near the end of each arm 30 so that the rollers are positioned for contact with a backside of the squeeze plates 22. In operation, when the squeeze handle 24 slides down the mop handle 14, the driving link 26 and fork 28 are driven downward so that the rollers 32 contact the backsides of the squeeze plates 22. As the squeeze handle 24 continues in a downward direction, the rollers 32 force the squeeze plates 22 to rotate, thereby compressing the sponge 18. After the sponge 18 has been sufficiently squeezed, the sponge handle 24 may be moved in the opposite direction upward along the mop handle 14 thereby reversing the above process and allowing the sponge 18 to unfold to its original, operative position.

Figure 3:
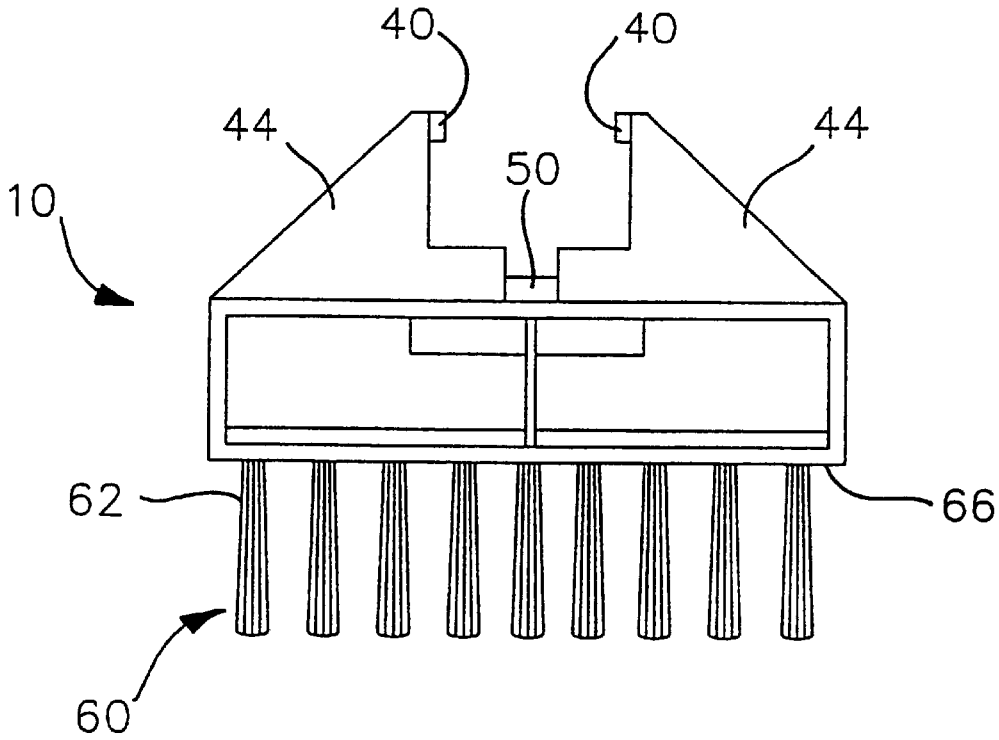
FIG. 3 is a top view of the scrubber adapter.

In accordance with certain aspects of the present invention, a scrubber adapter 10 is attached to the head attachment 16 for cleaning surfaces with difficult, ingrained soil. As best shown in FIG. 3, the scrubber adapter 10 has detent tabs 40 which fit the sides and front of the head attachment 16. Two arms 44 extend rearwardly from the scrubber adapter 10, each arm having a side detent tab 40 at an end thereof. In the illustrated embodiment, the side detent tabs 40 are sized for insertion into a notch 48 of the head attachment 16. A front detent tab 50 extents rearwardly from the adapter 10 and is sized to extend from a lower rear edge 52 of the head attachment 16. It will therefore be appreciated that when the adapter 10 is placed into position on the head attachment 16, the side and front detent tabs 40, 50 secure the adapter 10 in position.

Figure 4:
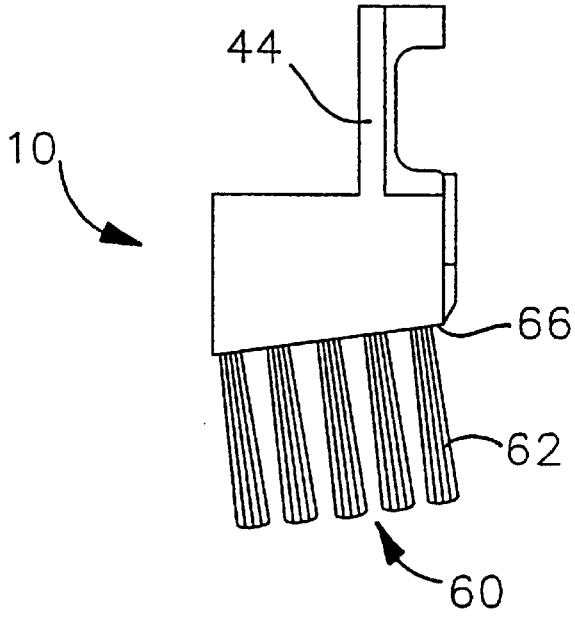
FIG. 4 is a side view of the scrubber adapter.

In accordance with additional features of the present invention, the adapter 10 presents a brush 60 for scrubbing the surface to be cleaned. As best shown in FIGS. 3 and 4, a number of bristles 62 are attached to the adapter 10. As shown in FIG. 4, the adapter 10 has an attachment surface 66 to which the bristles 62 are secured. While any known attachment method may be used, the bristles 62 are preferably either fused or staple-set to the adapter 10. In fusing, an end of each bristle 62 is heated and then brought in to contact with the attachment surface 66 to allow the bristle to fuse with the adapter 10. In staple-setting, a bundle of bristles 62 are positioned near the attachment surface 66 and a staple is driven in to the adapter 10 near a midpoint of the bundle. The force of the staple causes the bristles 62 to bend and double over so that ends of the bristles are disposed outwardly from the attachment surface 66. A plurality of bristle bundles are stapled to the adapter 10 to increase the size of the brush. Using either method, the bristles are secured to the adapter 10 and are sufficiently secured to perform scrubbing operations on the surface to be cleaned.

Figure 5:
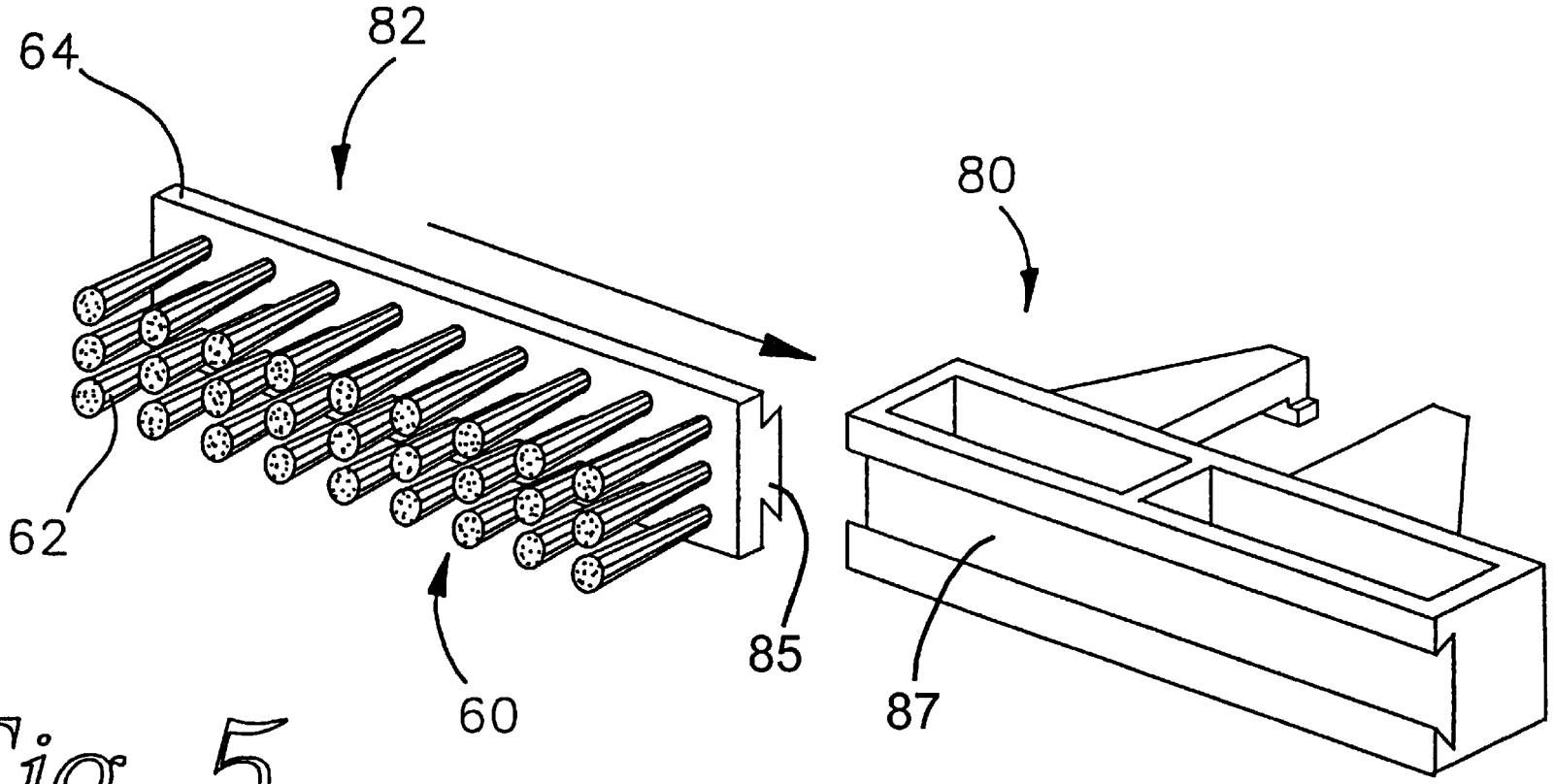
FIG. 5 is a perspective view of an alternative embodiment of the scrubber adapter having a replaceable brush head.

In an alternative embodiment, a scrubber adapter 80 has a removable brush head 82, as illustrated in FIG. 5. In this embodiment, the bristles 62 are secured to a base 64 which in turn may be releasably secured to the adapter 80. Mechanical means are used to secure the base 64 to the adapter 80. For example, as shown in FIG. 5, the base 64 has a dovetail projection 85 which mates with a notch 87 in the adapter 80. As a result, the base 84 may be slid in place on the adapter 80 for scrubbing, and may be removed and replaced when the brush is spent. In this embodiment, therefore, a spent brush head 82 may be quickly and easily replaced without necessitating replacement of the scrubber adapter 80.

From the foregoing, it will be appreciated that the present invention brings to the art a new and improved scrubber adapter for attachment to a butterfly mop. The scrubber adapter presents a brush surface for performing scrubbing operations on the surface to be cleaned. The brush provides a familiar tool to the typical mop user and therefore is more likely to be used in the appropriate manner. Furthermore, the brush is less abrasive than other scrubber strip type materials and therefore is less likely to damage the surface. In an alternative embodiment, the brush is attached to a removable backing which in turn may be connected to the scrubber adapter. As a result, the brush may be quickly and easily replaced without replacing the entire scrubber adapter.

What is claimed is:

1. A butterfly mop comprising in combination:

a butterfly mop head attached to a handle;

a scrubber attachment having an attachment structure including arms adapted to overlie a squeeze assembly on the butterfly mop and detent tabs for fitting into apertures on the mop head; and the mop having a mopping surface, and the scrubber attachment when mounted by means of the detent tabs having a scrubbing surface generally at a right angle to the mopping surface; and bristles affixed to the scrubbing surface and engageable with a floor to be scrubbed when the mop is rotated to bring the mopping surface out of contact and the scrubbing surface into contact with the floor.

2. The combination of claim 1 in which the bristles are permanently affixed to the scrubber attachment and are of sufficient length to provide a durable scrubbing surface.

3. The combination of claim 1 in which the bristles are attached to a bristle plate, and dovetail means are provided for connecting the bristle plate to the scrubber attachment for ready replacement of the bristles, while maintaining a secure mounting of the bristles for scrubbing.

4. The combination as set forth in claim 3 in which the bristles are in a generally rectangular configuration in which the long axis of the rectangular configuration is parallel to a long axis of the and mopping surface, and the dovetail has an axis parallel to the long axis of the rectangular configuration of bristles, whereby back and forth scrubbing on the floor creates forces on the dovetail which are normal to the dovetail.

* * * * *